US007793422B1

(12) United States Patent
Kennedy

(10) Patent No.: US 7,793,422 B1
(45) Date of Patent: Sep. 14, 2010

(54) ARCHERY BOW SITE (LIL BOW PEEP)

(76) Inventor: Mickey McArthur Kennedy, 1035 W. Liberty, Medina, OH (US) 44256

( * ) Notice: Subject to any disclaimer, the term of this patent is extended or adjusted under 35 U.S.C. 154(b) by 0 days.

(21) Appl. No.: 12/284,134

(22) Filed: Sep. 19, 2008

(51) Int. Cl.
*F41G 1/467* (2006.01)

(52) U.S. Cl. ..... 33/265; 124/87

(58) Field of Classification Search ..... 33/265; 124/87, 88
See application file for complete search history.

(56) References Cited

U.S. PATENT DOCUMENTS 4,570,352 A * 2/1986 Leal ..... 33/265
5,671,724 A * 9/1997 Priebe ..... 124/87
5,802,726 A * 9/1998 Trosper et al. ..... 33/265
7,461,460 B2 * 12/2008 Priebe ..... 33/265
7,594,335 B1 * 9/2009 Schmitz ..... 33/265
2003/0136012 A1 * 7/2003 Walbrink ..... 33/265
2003/0177651 A1 * 9/2003 Stone ..... 33/265
2008/0163503 A1 * 7/2008 Priebe ..... 33/265

* cited by examiner

*Primary Examiner*—G. Bradley Bennett

(57) ABSTRACT

This innovation is to provide a better aiming device for archers utilizing a single frame with all components of the aiming device attached to it. This invention gives faster sight acquisition, clearer view thru sights and eliminates bow twist.

16 Claims, 7 Drawing Sheets

Adjustable peep assembly.
Attached to main frame.

Adjustable peep assembly.

Top view.

Bottom view.

Right side elevation.

Main frame measurements.

Tallest point in middle 1-7/8in.
Total length of frame assembly to be 12in. .

Fiber optic device.

ARCHERY BOW SITE (LIL BOW PEEP)

The manufacturing of this bow sight requires a blank piece of stock measuring ⅜ in By 2 in by 12 in. Can also be injection moulded.

The layout of holes for weight reduction can be of any configuration but not in any manner which would destroy the integrity of stock. Important hole layout will be the main elongated hole for elevation adjustments. This elongated hole along with the peep relocation are mainstays of Invention. See blueprint for more details.

Starting on the peep end of site and following along the centerline of apparatus, main frame will be 1M. In height and continue toward front end for a distance of 2½ in. At this point you start an increase in height of main frame for a distance of mainframe for a distance of 2¾ in. At this point, main frame is 1⅞ in tall equal on both sides. (See blueprint). Main frame reduces at this point to 1 in. Total length of main frame will be 12 in. The end of frame will have the pin holding device mounted in a clamping arrangement of a ⅝ in hole open on the end and a 5/16 hole with relief cut between holes. A 6-32 socket screw will provide tension for clamping the pin holder in frame. This archery sight main frame will facilitate several variations of bow sight pins. The peep end of frame is of such that a fixed peep or an adjustable one can be utilized. The fixed peep for this frame is manufactured using a SS 8-32 socket head bolt, and 8-32 locking nut with a gnarled peep lock. The peep is manufactured using a section of stock and shaping the peep per drawing. See blueprints.

Figure 1:
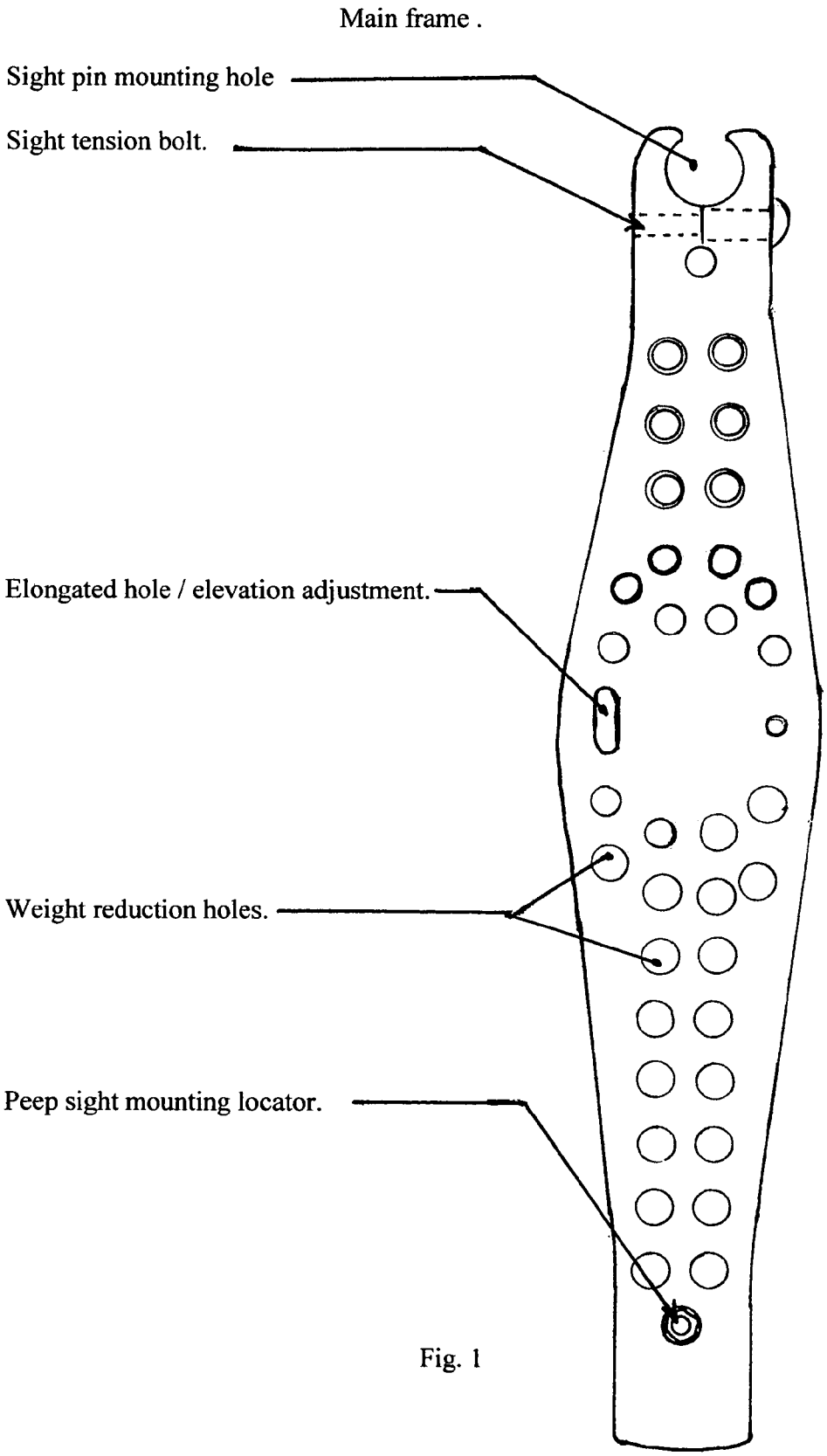
FIG. 1 HERE YOU WILL FIND THE MAIN FRAME WITH ELONGATED MOUNTING HOLE AND ALL OTHER HOLES AND OPENINGS FOR MOUNTING OTHER PARTS OF SIGHTING DEVICE. FRAME CAN HAVE VARIOUS WEIGHT REDUCTION HOLES NOT NECESSARILY ASSOCIATED WITH THIS VIEW. THE ELONGATED HOLE BEING AN ESSENTIAL PART OF INVENTION.
Figure 2:
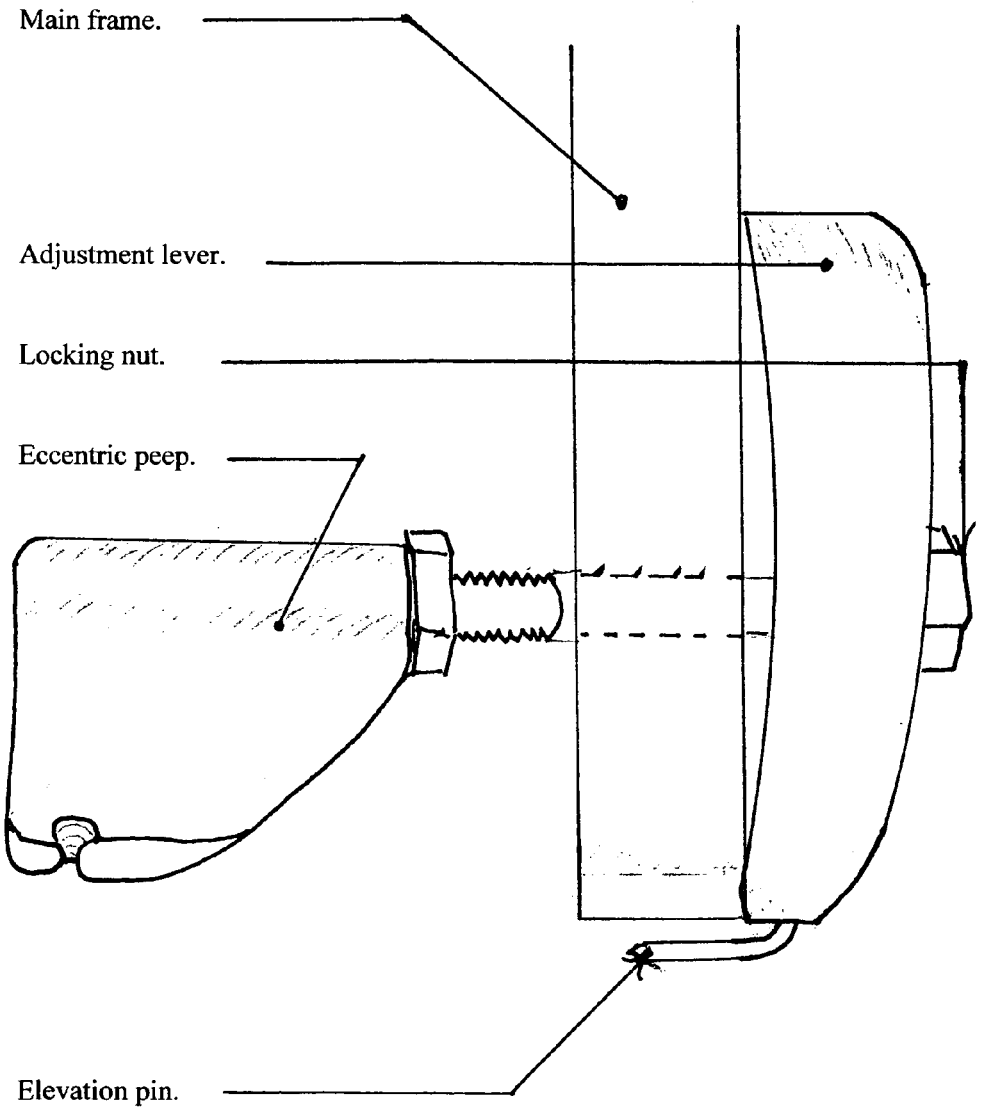
FIG. 2 HERE YOU WILL FIND THE ADJUSTABLE PEEP ASSEMBLY DEPICTING ATTACHMENT TO THE MAIN FRAME. PARTICULAR ATTENTION TO THE ECCENTRIC SHAPE OF PEEP GIVING IT ITS VARIABLE CAPABILITIES.
Figure 3:
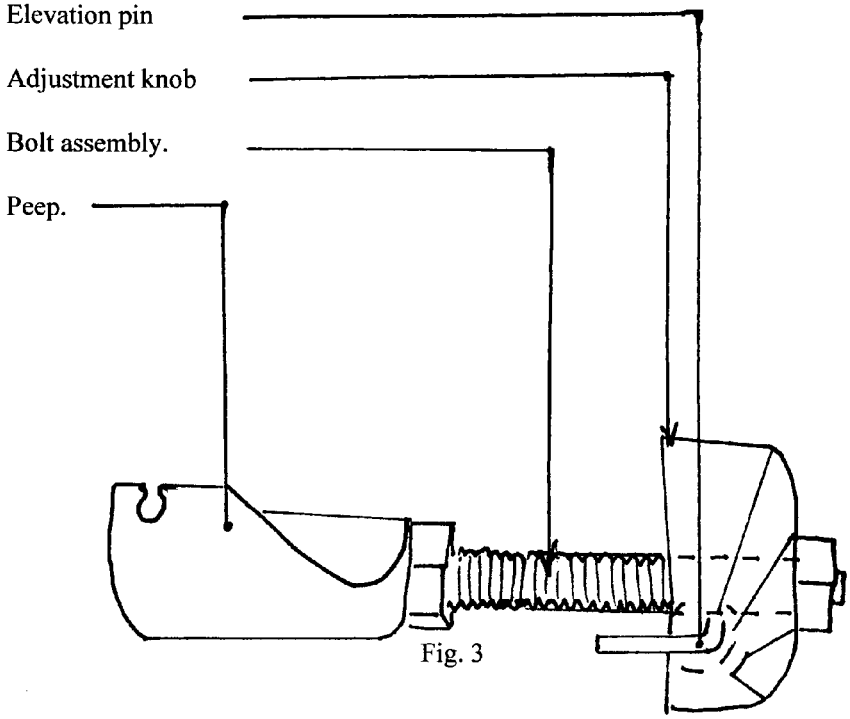
FIG. 3 IN THIS FIGURE WE ARE SHOWING THE PEEP ASSEMBLY UNATACHED TO MAIN FRAME. FOR CLARITY OF DRAWING, ADDITIONAL VIEWS OF PEEP ARE SHOWN.
Figure 4:
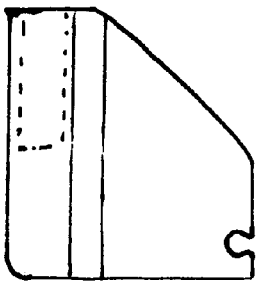
FIG. 4 A VIEW FROM THE TOP OF PEEP UNATTACHED TO PEEP ASSEMBLY.
Figure 5:
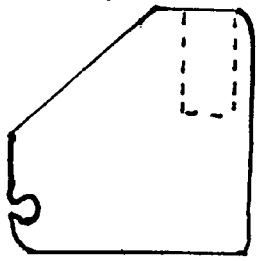
FIG. 5 VIEW FROM THE BOTTOM OF PEEP. THIS VIEW AND DRAWING NOT RESTRICTIVE TO ITS OVERALL SHAPE. MOST IMPORTANT IS THE PEEP HOLE AND SLOT AT TOP OF HOLE.
Figure 6:
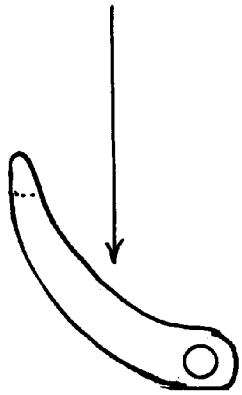
FIG. 6 A SIDE VIEW OF PEEP DEPICTING ITS SHAPE AND ECCENTRICITY GIVING IT ITS VARIABLE CAPABILITIES.
Figure 7:
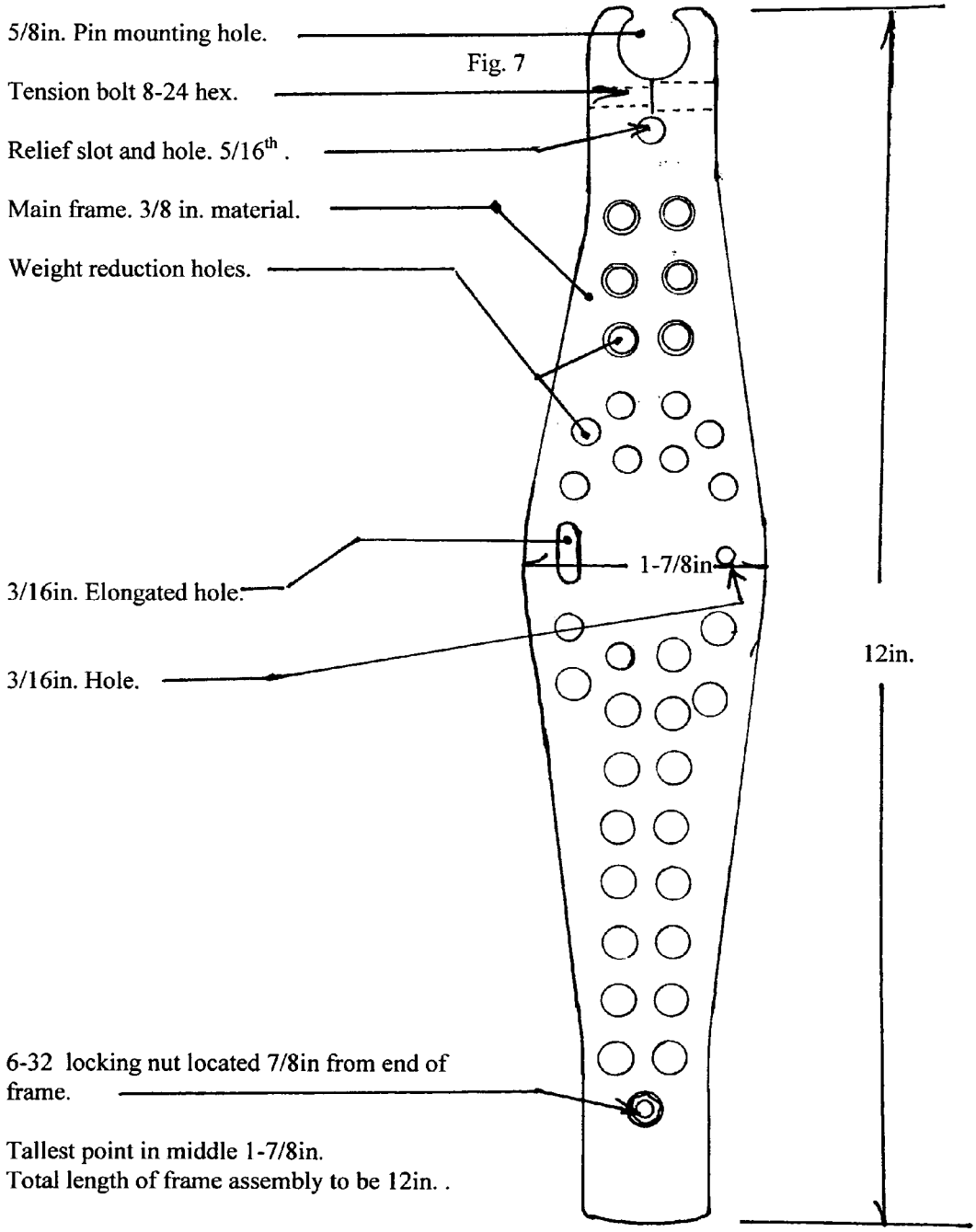
FIG. 7 THIS IS A VIEW OF MAIN FRAME WITH MEASUREMENTS OF HOLE LOCATIONS, TO INCLUDE HOLES FOR ATTACHED PARTS. SIZES AND DEMINSIONS NOT RESTRICTED TO THIS VIEW ONLY.
Figure 8:
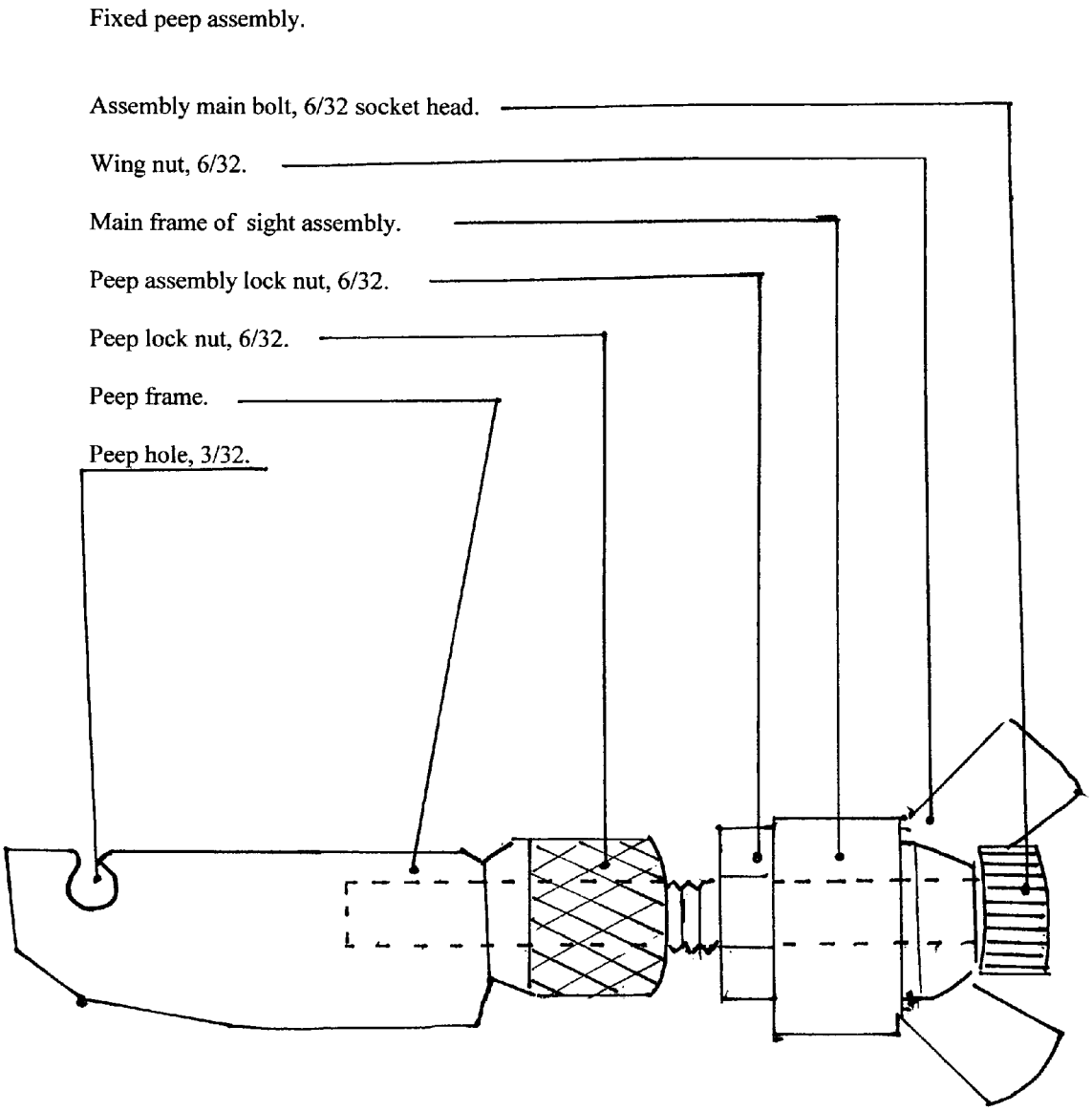
FIG. 8 THIS IS VIEW SHOWING THE USE OF A FIXED PEEP WHEN USING MULTIPLE PIN APPLICATIONS.
Figure 9:
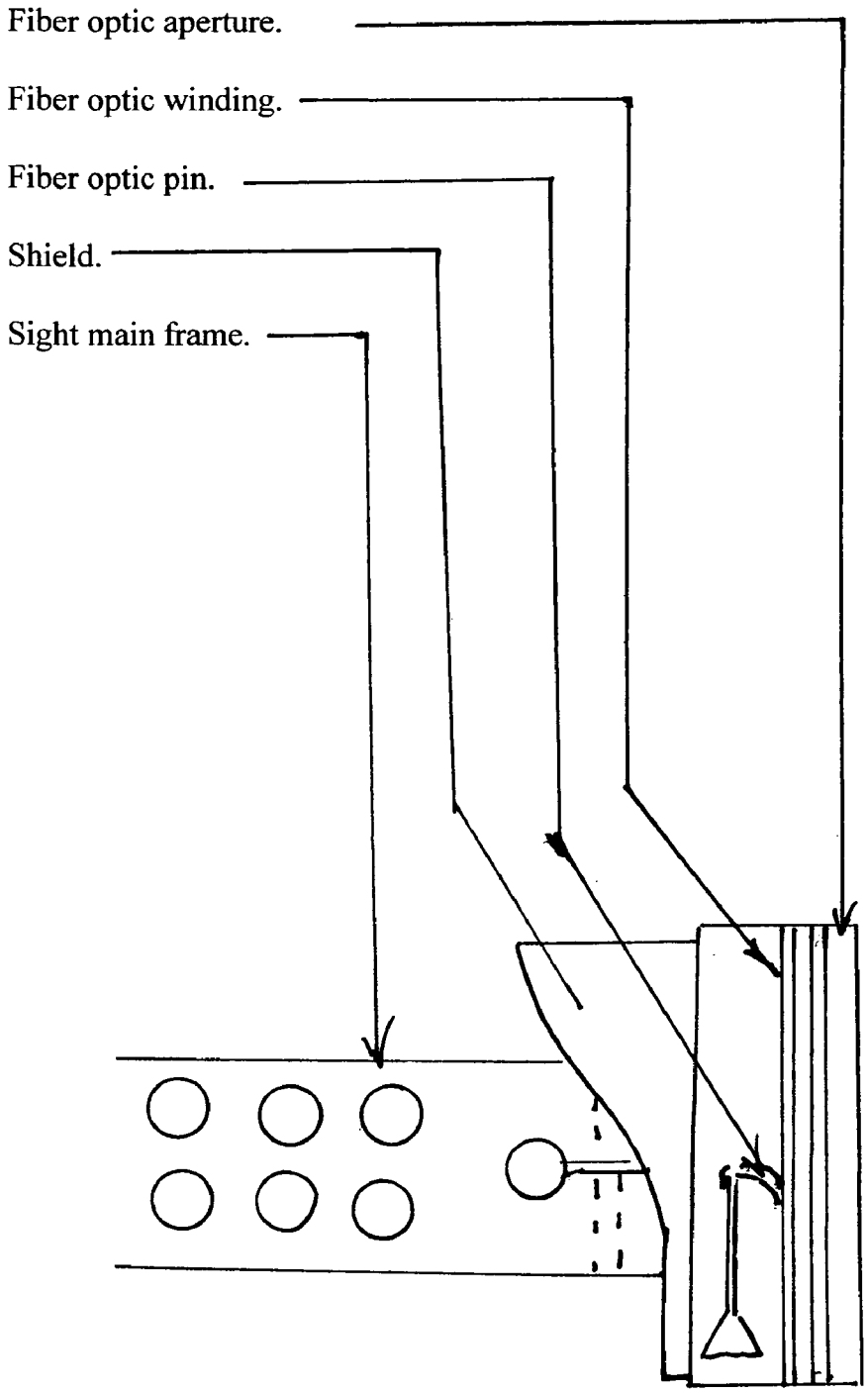
FIG. 9 VIEW SHOWING THE USE OF FIBEROPTIC PIN MOUNTED IN THE APERTURE AND ATTACHED TO MAIN FRAME WITH ADJUSTABLE BOLT.
Figure 10:
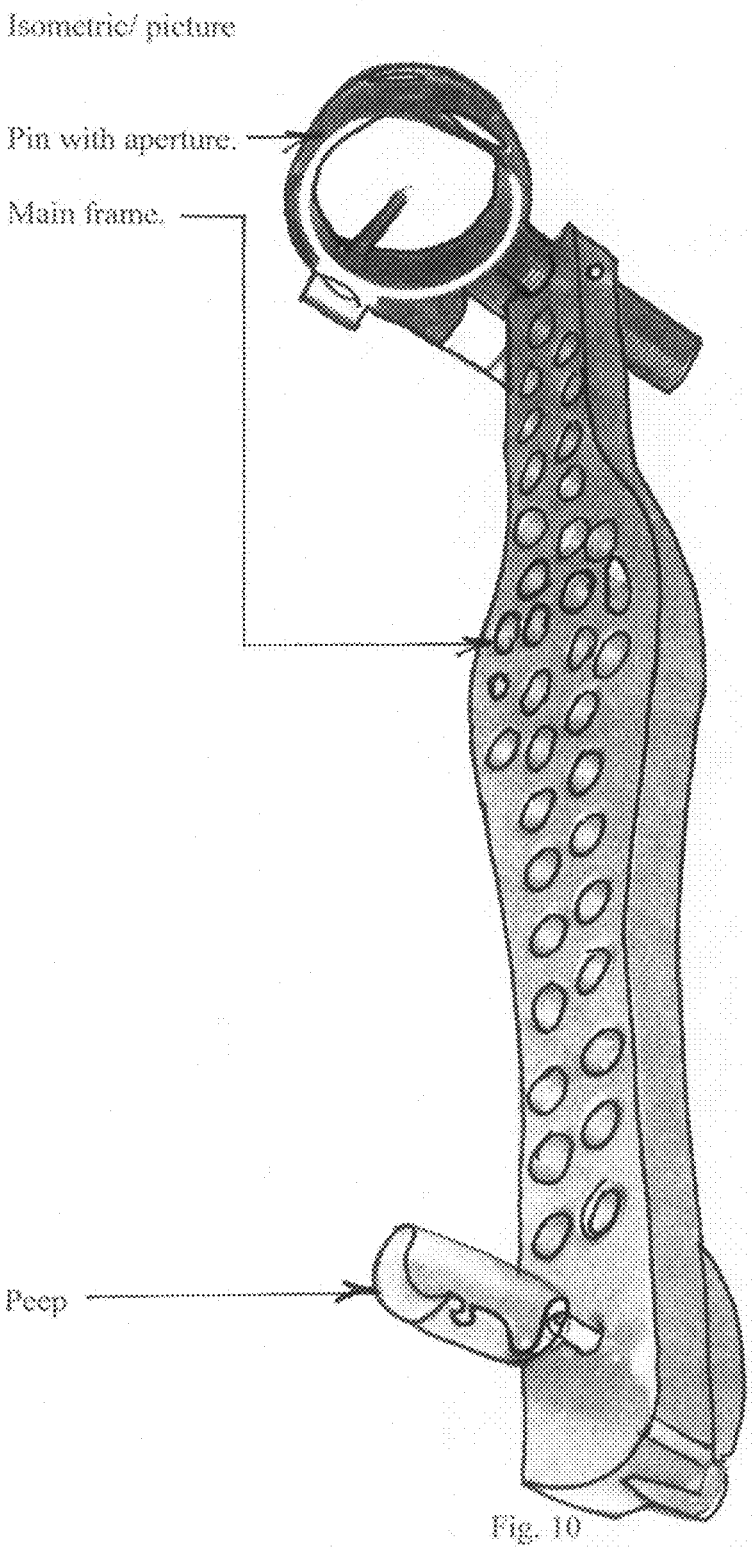
FIG. 10 ISOMETRIC OF ASSEMBLED PARTS TO SHOW ENTIRE SIGHTING DEVICE TO INCLUDE, MAIN FRAME, APERTURE/SHIELD WITH FIBEROPTIC PIN AND PEEP ASSEMBLY. ELONGATED HOLE AND ECCENTRIC PEEP ARE MAINSTAYS OF INVENTION.

The adjustable peep is manufactured by making an eccentric shaped piece % in by ¾ in. Attached to a lever thru main frame via a locking nut set and secured in frame. The adjustable elevation lever is located on rear half of main frame assembly. A hole is drilled in end of bar ⅞ in from end and peep assembly is mounted thru this mounting hole. Rear of frame has marker for designated ranges. Third element of invention. The elevation location pin is located in end of lever and pointed for accuracy in setting for individual shooting habits and bow strength. To be determined when zeroing bow.

The invention claimed is:

1. An apparatus that facilitates archery bow targeting, comprising:

a sight frame configured to attach at a substantially perpendicular angle to a riser of an archery bow by way of an elongated hole, wherein the substantially perpendicular angle varies as a function of a location of an attachment means within the elongated hole;

a sight component attached to a fore end of the sight frame by way of a sight shaft, wherein the sight component comprises at least one sight pin; and a peep component comprising a peep hole, wherein the peep component is attached to an aft end of the sight frame by way of a peep shaft, and wherein the peep component is configured to vary an axis between the peep hole and the at least one sight pin based upon rotation of the peep shaft.

2. The apparatus of claim 1, wherein the peep component is substantially comma-shaped.

3. The apparatus of claim 1, further comprising an actuator component attached to the peep shaft, wherein the actuator component is configured to rotate the peep shaft.

4. The apparatus of claim 3, wherein the actuator component comprises a pointer means, wherein a location along the aft end of the sight frame designated by the pointer means represents a setting associated with a distance to a target of the archery bow.

5. An apparatus that facilitates convenient elevation setting adjustment in connection with archery bow targeting, comprising:

a sight frame configured to mount to a riser of an archery bow at a substantially perpendicular angle, the sight frame comprising:

an elongated hole situated approximately along a lateral axis of the sight frame, wherein the substantially perpendicular angle varies as a function of a location within the elongated hole of an attachment means; and an fore hole situated at a fore end of the sight frame, wherein the fore hole is configured to receive a sight shaft that supports a sight aperture mount.

6. The apparatus of claim 5, further comprising the sight aperture mounted to the sight shaft, wherein the sight aperture comprises one or more sight pin.

7. The apparatus of claim 5, further comprising an aft hole situated at an aft end of the sight frame, wherein the aft hole is configured to receive a peep shaft that supports a peep module.

8. The apparatus of claim 7, further comprising the peep module mounted to the peep shaft, wherein the peep module comprises a peep hole.

9. The apparatus of claim 8, wherein the peep module is configured to vary an axis between the peep hole and the one or more sight pin based upon rotation of the peep shaft.

10. The apparatus of claim 8, wherein the peep module is substantially comma-shaped.

11. The apparatus of claim 8, further comprising an actuator component attached to the peep shaft, wherein the actuator component is configured to rotate the peep shaft.

12. The apparatus of claim 11, wherein the actuator component comprises a pointer means, wherein a location along the aft end of the sight frame designated by the pointer means represents a setting associated with a distance to a target of the archery bow.

13. An apparatus that facilitates archery bow targeting, comprising:

a peep component configured to couple to a sight frame supported by a riser of an archery bow, the peep component comprising:

a. peep hole;

a peep shaft configured to couple the peep component to the sight frame; and an actuator coupled to the peep shaft, wherein the actuator facilitates rotation of the peep shaft that rotates the peep hole in a corresponding arc.

14. The apparatus of claim 13, wherein the peep component is substantially comma-shaped with the peep hole at a first end and the peep shaft at a second end.

15. The apparatus of claim 13, further comprising the sight frame.

16. The apparatus of claim 15, wherein the actuator comprises a pointer means, wherein a location along an aft end of the sight frame designated by the pointer means represents a setting associated with a distance to a target of the archery bow.

* * * * *